United States Patent [19]

Matsuyama et al.

[11] Patent Number: 4,747,816

[45] Date of Patent: May 31, 1988

[54] APPARATUS FOR MAKING A FILTER FROM A MATERIAL FOR A FILTER ELEMENT

[75] Inventors: Harukazu Matsuyama, Takahama; Tetsuo Kato, Toyota; Yasuo Hibi, Oobu; Satoshi Inukai; Masanori Suzuki, both of Kariya; Yoshimitsu Yamaguchi, Anjo, all of Japan

[73] Assignee: Nippondenso Co., Ltd., Kariya, Japan

[21] Appl. No.: 41,005

[22] Filed: Apr. 21, 1987

[30] Foreign Application Priority Data

Apr. 28, 1986 [JP] Japan ..... 61-99236
May 2, 1986 [JP] Japan ..... 61-102745
May 2, 1986 [JP] Japan ..... 61-102746

[51] Int. Cl.[4] ..... B31F 1/34

[52] U.S. Cl. ..... 493/407; 156/207; 156/218; 156/474; 210/500.23; 425/369; 425/392; 425/444; 493/463; 493/464; 493/941

[58] Field of Search ..... 493/941, 464, 463, 466, 493/407, 42, 185; 425/343, 383, 369, 392, 444; 156/474, 207, 218, 204, 462; 210/500.23; 55/527; 162/117, 231; 264/294, 324, 323, DIG. 48; 29/163.5 F

[56] References Cited

U.S. PATENT DOCUMENTS 2,084,362 6/1937 Visscher et al. ..... 156/462
2,685,827 8/1954 Mason ..... 493/464
2,685,828 8/1954 Mason et al. ..... 493/464
2,761,490 9/1956 Walton ..... 425/369
3,948,712 4/1976 Stannard ..... 493/941
4,252,591 2/1981 Rosenberg ..... 156/474

*Primary Examiner*—Jerome Massie
*Assistant Examiner*—David Herb
*Attorney, Agent, or Firm*—Cushman, Darby & Cushman

[57] ABSTRACT

An apparatus performing a filter from a material for a filter element automatically and quickly. The filter made by the present apparatus has a plurality of wavy portions which are provided in such a manner that a plurality of wavy portions forms a circle.

The apparatus employs a contracting apparatus for contracting a continuously corrugated strip of material for a filter element in such a manner that a distance between adjacent ridges of the corrugated strip is reduced so that the corrugated strip becomes the wavy portion of the filter. The apparatus also employs a rounding apparatus for rounding the continuously corrugated strip in such a manner that both ends of the strip are connected to each other so that the wavy portions made from the corrugated strip form a circle. The apparatus further employs a shaping apparatus for shaping the rounded continuously corrugated strip so that the rounded strip becomes the filter.

4 Claims, 9 Drawing Sheets

APPARATUS FOR MAKING A FILTER FROM A MATERIAL FOR A FILTER ELEMENT

(FIELD OF THE INVENTION)

The present invention relates to an apparatus for making a filter from a material for a filter element. The apparatus of the present invention contracts a continuously corrugated strip of material for a filter element so that the distance between adjacent ridges of the corrugated strip is reduced. More particularly, the apparatus of the present invention is useful for contracting a corrugated material for a filter element having a plurality of alternating groups of high and low ridges in the direction in which those ridges are juxtaposed to one another.

The present invention also relates to an apparatus for rounding a continuously corrugated strip of material for a filter element so that both ends of the strip are joined to each other.

The present invention further relates to an apparatus for shaping a continuously corrugated strip of material for a filter element to make a predetermined ring shaped filter.

(BACKGROUND OF THE INVENTION)

An apparatus for contracting a continuously corrugated material in the direction in which its ridges are juxtaposed to one another has been known. This kind of apparatus is, for example, used for reducing the pitch or distance between the riges defining the fins on a heat exchanger. The conventional apparatus includes a guide plate on which the lower side of a continuously corrugated material which is fed by toothed forming or feeding rollers is supported, and a braking plate pressing against the upper side of the corrugated material to create a frictional braking force to reduce the pitch between adjacent ridges.

The conventional apparatus has, however, the disadvantage that the contracted material cannot be controlled by its pitch between adjacent ridges. As the braking plate is pressed against the ridges of a corrugated material to contract it, the braking or contracting force caused by the braking plate should be varied with the height of the ridges and the variation of the contracting force makes the pitch between the ridges on the contracted material irregular. The conventional apparatus is, therefore, unusable for contracting a corrugated material having a varying ridge height.

Though a filter having a plurality of wavy portions which are provided in such a manner that a plurality of wavy portions forms a circle has already been invented, an apparatus for rounding a continuously corrugated strip of material for a filter element in order to make such filter has not been invented. Therefore, such an apparatus for rounding the continuously corrugated strip is eagerly required.

Though the filter having a continuously corrugated wavy portion arranged in such a manner that a plurality of wavy portions form a circle has been invented, the apparatus for shaping such filter automatically and quickly has not been provided. Therefore, such an apparatus for shaping the filter is eagerly required.

(SUMMARY OF THE INVENTION)

An object of the present invention is to provide an apparatus for forming a filter from a material for a filter element.

Another object of the present invention is to provide an apparatus for contracting a material for a filter element which can control the pitch between adjacent ridges of the contracted material.

A further object of the present invention is to provided an apparatus for rounding a continuously corrugated strip automatically. Especially the apparatus of the present invention has the object of winding a continuously corrugated strip quickly.

Still a further object of the present invention is to provide an apparatus for shaping the filter automatically and quickly.

According to the present invention, the foregoing objects are attained by an apparatus including the features which are described hereunder. A guide plate on which a corrugated material for a filter element slides is provided, and a plurality of guide grooves are formed on the guide plate. The guide grooves extend from one end of the guide plate to the other end in a direction perpendicular to the direction in which the corrugated material is contracted and are spaced apart from one another by a distance which decreases from one end of the guide plate to the other end. A plurality of lower guide members supports the corrugated material in such a manner that the lower guide members engages with the downwardly facing grooves in the lower surface of the corrugated material. The lower guide members move together along the guide grooves from one end of the guide plate to the other. A plurality of upper guide members are provided between every adjacent pair of lower guide members. Each of the upper guide members engages with one of upwardly facing grooves in the upper surface of the corrugated material. The upper guide members move together with the lower guide members and are spaced apart from one another by a distance which decreases with the movement of the upper guide members from one end of the guide plate to the other.

The upper and lower guide members are moved together in the direction perpendicular to the direction in which the corrugated material is contracted. The upper and lower guide members move in order to decrease their respective spacings so that the corrugated material which is supported by the lower guide members in some of the grooves on its lower side and by the upper guide members in some of the grooves on its upper side is corrugated until the ridges thereof have an appropriately reduced pitch therebetween.

The apparatus of the present invention can always produce a constant contracting force and can, therefore, reduce the pitch between the ridges on a corrugated material without causing any appreciable variation in ridge height. Moreover, it can be satisfactorily used for contracting even a corrugated material having a varying ridge height.

In order to attain the other objects, the present invention employs the features described hereinafter. A plurality of holding blocks which hold a continuously corrugated strip of material for a filter element are provided on a flat surface of a back plate. An adjacent pair of the holding blocks are rotatably connected to each other. Two blocks of a plurality of the holding blocks are pivoted on the back plate, and both ends of the holding blocks are connected with a rounding device so that a plurality of holding blocks form a circle. Both ends of the plurality of the holding blocks are attached to each other in order to hold the position of the holding blocks when the plurality of holding blocks form a circle.

The rounding apparatus of the present invention can round the continuously corrugated strip of material for a filter element automatically and quickly. The present apparatus can round the continuously corrugated strip effectively even though the width of the corrugation of the continuously corrugated strip can vary.

In order to attain further objects, the apparatus of the present invention employs a shaping block having a bore defined therethrough and a core member mounted therein. The sectional shape between the inner wall of the shaping block defining the bore and the outer wall of the core member is continuously varied from one end of the shaping block to the other end of the shaping block. The apparatus of the present invention further employs pushing means for pushing a filter element within the bore from one end of the shaping block to the other end of the shaping block.

A continuously corrugated strip of a material for filter element both-ends of which are connected to each other so that the continuously corrugate strip forms a ring is carried within the bore from one end of the shaping block to the other end of the shaping block by the pushing means. Since the sectional shape of the bore is continuously varied, the strip of material for a filter element is shaped to be a predetermined shape when the strip travels through the bore.

The apparatus of the present invention can shape the filter element to a predetermined shape automatically and quickly.

(DETAIL DESCRIPTION OF THE PREFERRED EMBODIMENT)

Figure 1:
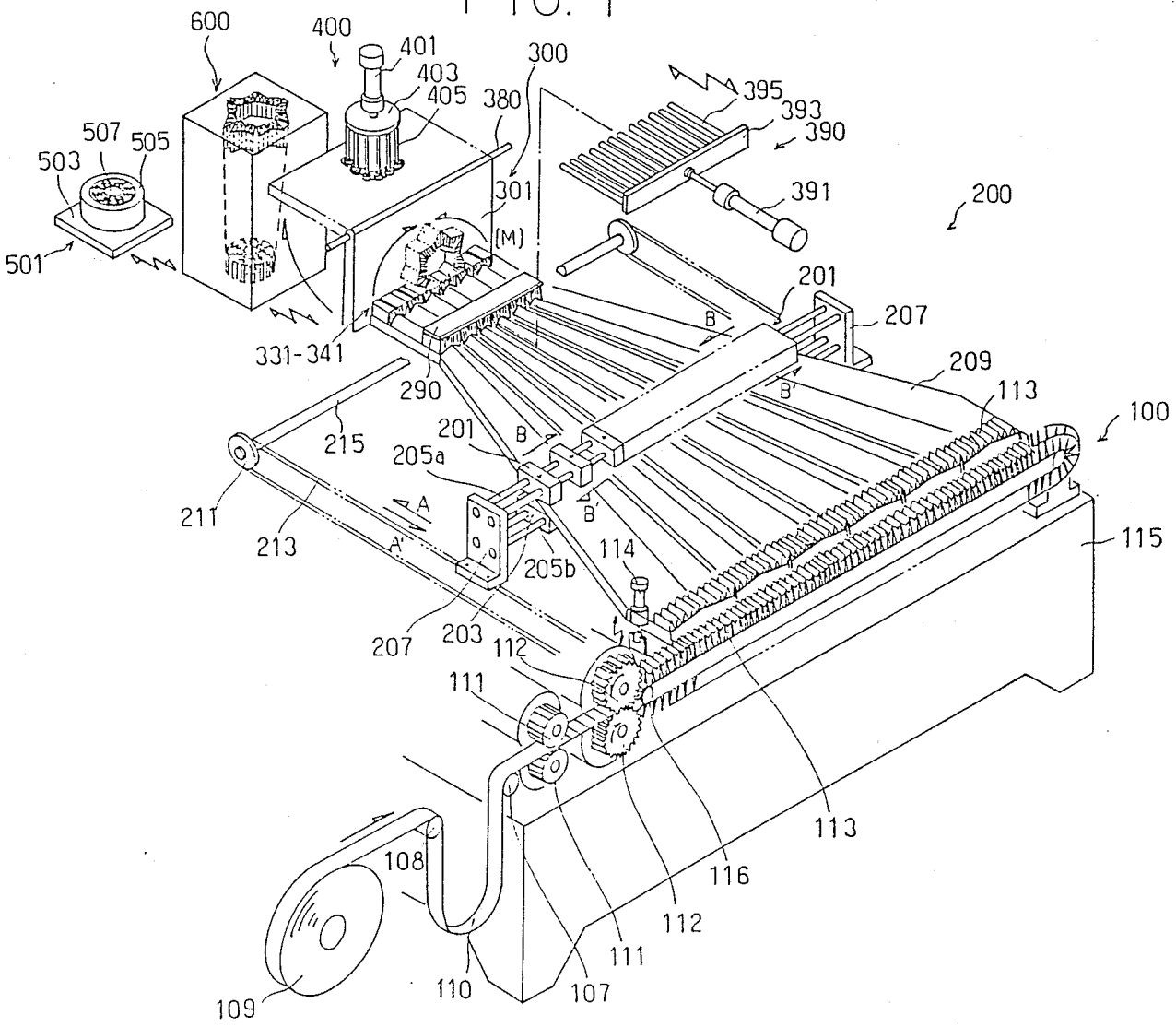
FIG. 1 is a perspective view of a filter manufacturing apparatus as a whole.

The present invention is described by way of example with reference to the drawings. FIG. 1 is a schematic view of a whole apparatus for manufacturing filter elements.

A strip 110 of a filter material containing a fixing agent is unwound from a roll 109 and advanced to a pair of line marking rollers 111 via a first auxiliary roller 108 and a second auxiliary roller 107. The strip 110 forms a sagging loop which keeps the tension of the strip under an appropriate level between the first and second auxiliary rollers 108 and 107.

Each of the line marking rollers 111 has a plurality of appropriately spaced apart line marking teeth on the outer peripheral surface thereof. The rollers 111 make a plurality of folding lines in the upper and lower surfaces of the strip 110 when the strip 110 passes between the rollers 111.

The strip 110 leaving the line marking rollers 111 travels to a pair of folding rollers 112. Each of the folding rollers 112 has a plurality of folding teeth on its outer peripheral surface. The rollers 112 fold the strip along the folding lines when the strip passes between the rollers 112. The folding teeth on each folding roller 112 consist of two sets of teeth, i.e., a first set of teeth having a gradually increasing height and a second set of teeth having a gradually decreasing height. The strip which has been folded into a corrugated form by the folding rollers 112 is cut by a cutter 114 to form a corrugated element 113 having an appropriate length. The element 113 is conveyed longitudinally by a feed chain 116.

The line marking rollers 111, the folding rollers 112 and the feed chain 116 are supported on a base 115 and define a folding device 100.

The element 113 which has been corrugated by the folding device 100 is, then, contracted by a contracting device 200 so that the distance between the ridges of the corrugated element are reduced. The contracted element 113 is transferred to a rounding device 300 by which the element 113 is rounded and joined at the opposite ends thereof to form an annular element. Then, the annular element is formed into a final shape by a final shaping device 400 and the finally shaped element is received onto a pallet 501 for delivery to a different apparatus or place.

Figure 2:
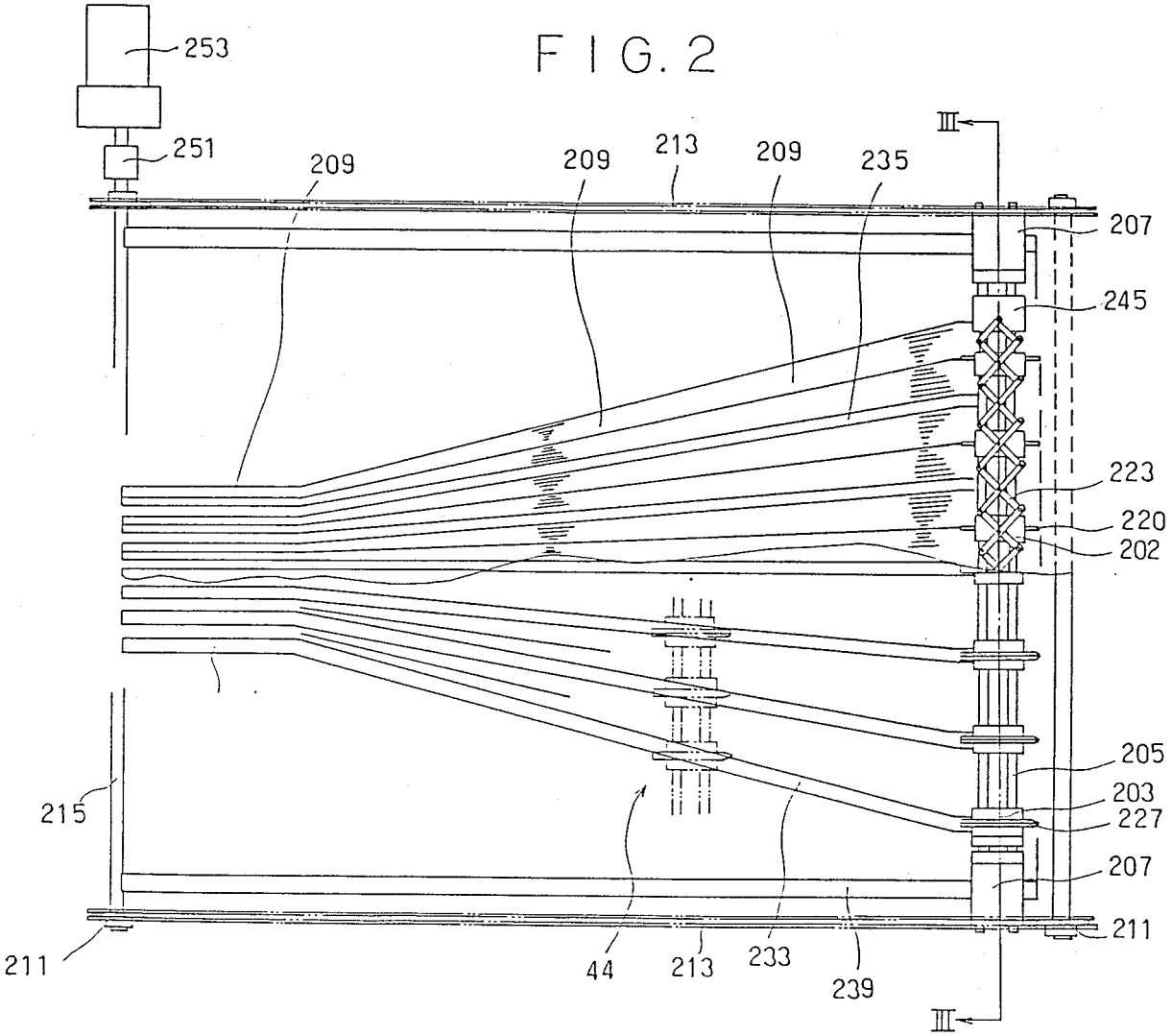
FIG. 2 is a top view of a contracting device.
Figure 3:
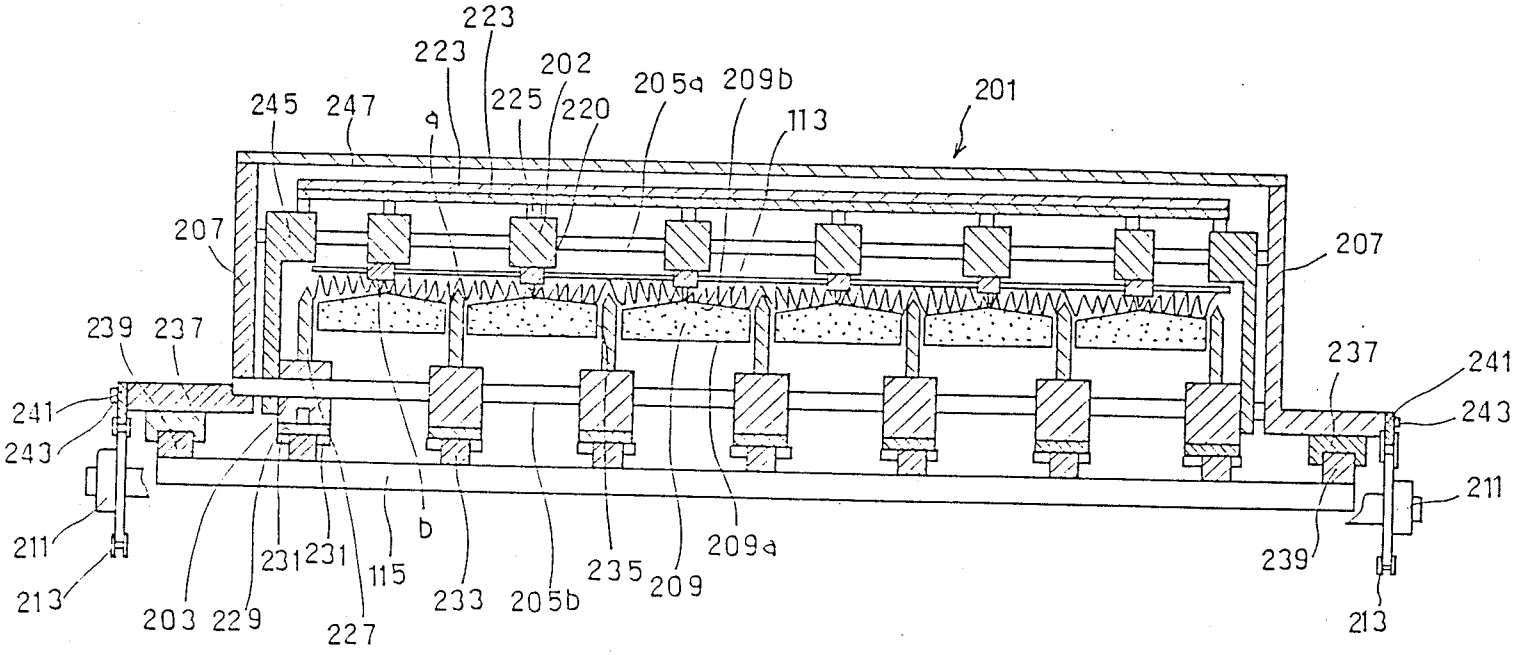
FIG. 3 is a sectional view taken along the line III—III of FIG. 2.

The construction of the contracting device 200 is described with reference to FIGS. 1 to 3. FIG. 2 is a top plan view of the contracting device 200 and FIG. 3 is a sectional view taken along the line III—III of FIG. 2. Two pieces of first guide rails 239 are provided along both sides of the base 115. A block 207 having an L-shaped vertical section is supported by a bearing 237 which is mounted on each of first guide rail 239. The two blocks 207 are connected each other by a top plate 247.

Seven pieces of second guide rails 233 are provided on the base 115. The second guide rails 233 are spaced apart from one another by a distance which gradually decreases from one end of the base 115 to the other end. The guide rails 233 have parallel end portions **233*a* adjacent to the other end of the base 115. A distance between the parallel end portions is smaller than that of remaining portions of the parallel end portions 233*a***.

A plate 229 on which a rectangular lower block 203 is secured is provided on each second guide rail 233. Guide rollers 231 which are capable of rolling on the second guide rail 233 is provided with the plate so that the plate 229 and the lower block 203 can move along the second guide rail 233.

A plate shaped lower guide member 227 elongating upwardly is fixed with the top surface of each lower block 203. The guide member 227 has an acute portion at an upper edge thereof.

A guide plate which is composed of six guide plate segments 209 is provided above the lower blocks 203 and the lower guide members 227. Every two adjoining guide plate segments 209 define therebetween a guide groove 235 which extends in parallel to the second guide rails 233, and in which one of the lower guide members 227 is movably disposed.

Figure 16:
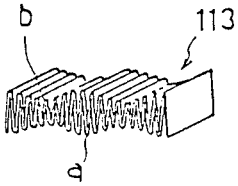
FIG. 16 is a perspective view of a filter element as folded and FIG. 17 is a view showing the movement of the rounding blocks.

Each guide plate segment 209 has a flat lower surface 209*a* and an angular upper surface 209*b* defining by a peak at the center of the segment 209. The guide plate segments 209 support the corrugated element 113 on the upper surfaces 209*b* thereof. The element 113 has a plurality of alternating groups of ridges having an increasing height and ridges having a decreasing height, as shown in FIG. 16. The upper surfaces 209*b* of the guide plate segments 209 are so shaped as to suit the varying height of the ridges on the element 113.

An upper guide member 220 is provided above the upper surface 209*b* of each guide plate segment 209 in such a manner that the member 220 faces the peak of the upper surface 209*b*. The upper guide member 220 is secured to an upper block 202 located thereabove. Two pieces of parallel upper guide bars 205*a* extend through six pieces of the upper blocks 202. The upper blocks 202 are slidablly by provided on the guide bars 205*a*.

Two pieces of parallel lower guide bars 205*b* extend through the lower blocks 203 so that the lower blocks 203 are able to slide along the lower guide bars 205*b*. A sliding block 245 is provided between each of the two outermost lower blocks 203 and one of the L-shaped blocks 207. The upper and lower guide bars 205*a* and 205*b* are secured to the sliding blocks 245 and the blocks 207.

A pantograph 223 is provided above the upper blocks 202 and the sliding blocks 245 and connected thereto by pins 225. The pantograph 223 comprises a plurality of link mechanisms as known in the art so that the contraction or the expansion of the link mechanisms causes the upper blocks 202 to move along the upper guide bars 205*a* to one another (as shown by an arrow B' in FIG. 1) or away from one another (as shown by an arrow B' in FIG. 1).

These elements such as the lower blocks 203, the lower guide members 227, the sliding blocks 245, the upper guide members 220, the upper blocks 202, the blocks 207, the pantograph 223, the upper guide bars 205*a* and the lower guide bars 205*b* constitute an expanding and contracting device 201.

An attachment 241 is joined to the outer edge of each block 207 by bolts 243. The attachment 241 is functionally connected with a chain 213 so that the block 207 is moved in accordance with the movement of the chain 213.

A pair of sprockets 211 which are connected each other by a connecting rod 215 are provided at each end of the base 115. Each chain 213 extends between one of the sprockets 211 provided at one end of the base 215 and one of the sprockets 211 at the other end thereof and is connected to one of the attachments 241.

A driving motor 253 is connected by a coupling 251 to one end of the connecting rod 215 which connects one of the pairs of sprockets 211 so that the output of the motor 253 is transmitted through the coupling 251 to the sprockets 211 to rotate them and thereby the chains 213 is moved in the direction of an arrow A in FIG. 1.

Each guide plate segment 209 has a converging portion 209*a* and a parallel portion 209*b* extending from the convergent end of the converging portion 209*a*, as shown in FIG. 2.

A shaping gate 290 is provided at the junction between the converging and parallel portions 209*a* and 209*b* as shown in FIG. 1. The gate 290 permits the element 113 which has been contracted to an appropriate length to pass therethrough. After the element 113 has reached the gate 290, the element 113 is then pushed forward toward the rounding device 300 along the parallel portions 209*b* by a pushing mechanisim 390 as shown in FIG. 1. The pushing mechanism 390 is comprised of a plurality of push rods 395, a connecting plate 393 to which each push rod 395 is connected and a pushing cylinder 391 connected to the connecting plate 393.

Figure 4:
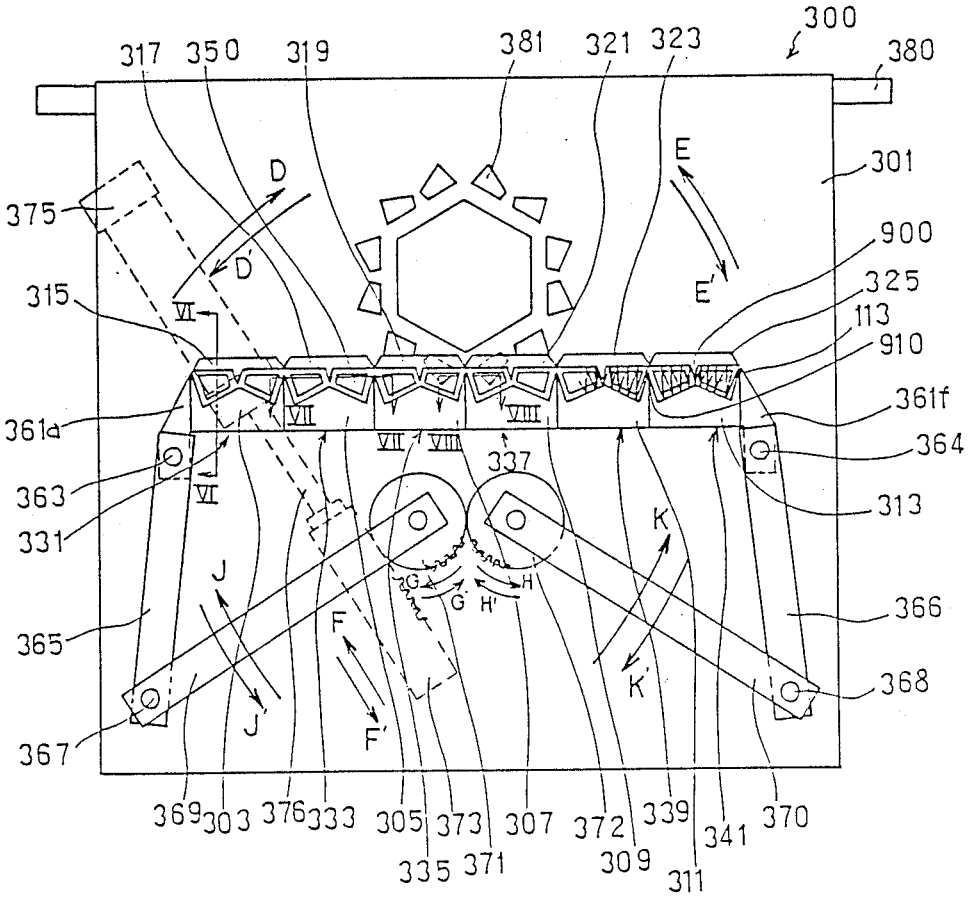
FIG. 4 is a front elevational view of a rounding device.

The rounding device 300 will now be described in detail. FIG. 4 is a front elevational view of the rounding device 300. A substantially square back plate 301 has an upper edge provided with a shaft 380 about which it is rotatable. Six pieces of rounding blocks 331, 333, 335, 337, 339 and 341 are provided on the back plate 301. Each of the rounding blocks 331 to 341 comprises an upper block 315, 317, 319, 321, 323 and 325 and a lower block 303, 305, 307, 309, 311 and 313. The upper blocks 315 to 325 and the lower blocks 303 to 313 define therebetween an open space 350 which extends throughout all of the blocks for receiving a single element 113 therein.

A projection 900 which extends into the element holding space 350 is provided at approximately center of each of the upperblocks 315–325. A projection 910 which likewise extends into the space 350 are provided at the adjoining ends of every two adjacent lower blocks. The projection 900 of each upper block is located at one of the lowest ridge portions of the element 113 and the projection 910 of each lower block is located at the highest ridge portions thereof.

Links 361*a*, 361*b*, 361*c*, 361*d*, 361*e* and 361*f* are provided between the back plate 301 and each of the rounding blocks 331 to 341.

Figure 6:
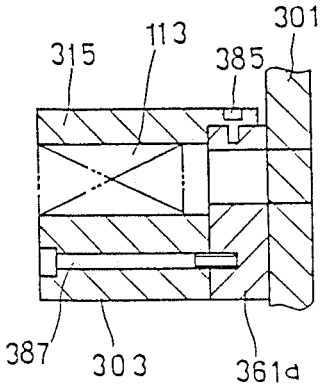
FIG. 6 is a sectional view taken along the line VI—VI of FIG. 4.

FIG. 6 is a sectional view taken along the line VI—VI of FIG. 4. As shown from FIG. 6, the upper block 315 is connected to the link 361*a* by a connecting pin 385 and the lower block 303 is connected to the link 361*a* by a bolt 387.

Figure 7:
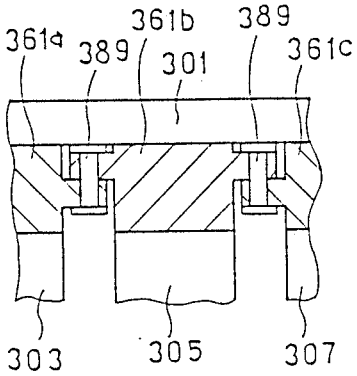
FIG. 7 is a sectional view taken along the line VII—VII of FIG. 4.

FIG. 7 is a sectional view taken along the line VII—VII of FIG. 4. As shown from FIG. 7, every two adjoining link plates 361*a* and 361*b* or 361*b* and 361*c* are rotatably connected to each other by a pin 389. Therefore, the rounding blocks 331 to 341 are rotatably connected around the respective pins 389.

Figure 8:
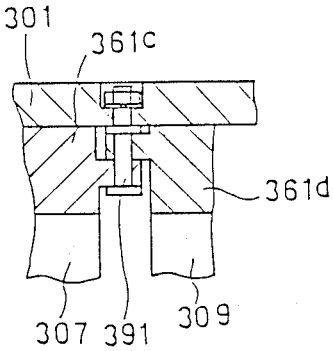
FIG. 8 is a sectional view taken along the line VIII—VIII of FIG. 4.

FIG. 8 is a sectional view taken along the line VIII—VIII of FIG. 4. As shown therefrom, the link plates 361*c* and 361*d* which are located behind the respective central rounding blocks 335 and 337, are rotatably connected to each other by a pin 391 which rotatably connects the link plates 361*c* and 361*d*to the back plate 301.

Links 365 and 366 are connected to the respective outermost link plates 361*a* and 361*f*, by pins 363 and 364. Levers 369 and 370 are rotatably connected to the other ends of the respective links 365 and 366, by pins 367 and 368. A first gear 371 and a second gear 372 each having a toothed outer peripheral surface are rotatably connected to the ends of the respective levers 369 and 370.

The first gear 371 meshes with a rack 373 which is connected to an actuator 375 which comprises a hydraulic or pneumatic cylinder via a connecting rod 376. The reciprocatory motion of the actuator 375 causes the rack 373 move in the direction of an arrow F or F' in FIG. 4. The first gear 371 is, therefore, rotated in the direction of an arrow G or G' to thereby move the lever 369 in the direction of an arrow J or J'. The first and second gears 371 and 372 mesh with each other and the rotation of the first gear 371 in the direction of the arrow G or G', therefore, causes the rotation of the second gear 372 in the direction of an arrow H or H' and thereby the rotation of the lever 370 in the direction of an arrow K or K'.

The rotation of the levers 369 and 370 in the directions of the arrows J and K, respectively, causes the link plates 365 and 366 rotate around the pin 391 in the directions of arrows D and E, respectively. As a result, the element rounding blocks 331 to 341 are raised in two opposite directions from the pin 391 and the outermost blocks are joined to each other to form a circular array as shown in FIG. 5.

Figure 5:
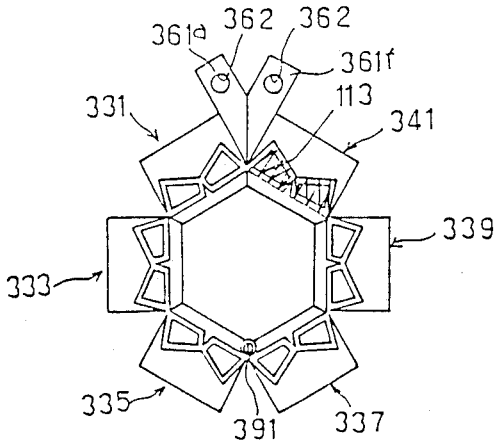
FIG. 5 is a front elevational view of rounding blocks in a curcular array.

The back plate 301 is provided therethrough with a plurality of separate pusher rod receiving holes 381 forming a circular array with which the element holding space 350 in the circular array of the rounding blocks as shown in FIG. 5 is alignable.

Figure 9:
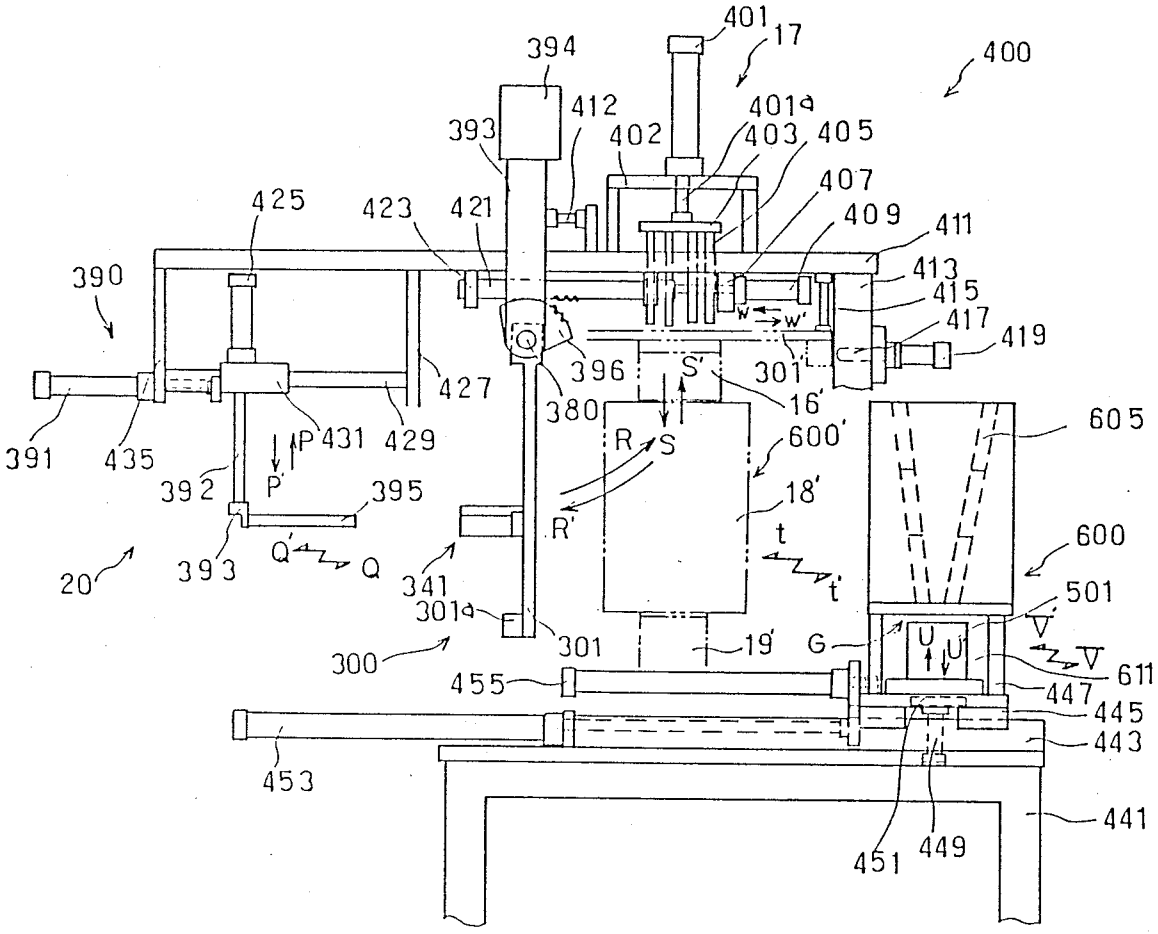
FIG. 9 is a side elevational view of a pusher, the rounding device and a shaping device.

FIG. 9 is a side elevational view of the pusher 390, the rounding device 300 and the shaping device 400. A plate 393 and a sectoral gear 396 are rotatably connected to the shaft 380 provided at the upper end of the back plate 301. A weight balancer 394 having an appropriate weight is secured to the other end of the plate 393 remote from the shaft 380. The sectoral gear 396 has a toothed arcuate surface. A rack 421 meshes with the teeth of the sectoral gear 396. The rack 421 is longitudinally movably supported by bearings 423 and 407. An actuator 409, which may, for example, comprise a pneumatic or hydraulic cylinder, is provided at the other end of the rack 421 remote from the sectoral gear. The bearings 423 and 407 are secured to an upper plate 411.

The pusher 390 faces the rounding blocks 331 to 341 of the rounding device.

The pusher 390 includes a plurality of pusher rods 395 for pushing a corrugated element into the element holding space 350 of the rounding blocks and a connecting plate 393 to which each pusher rod 395 is connected at one end. A shaft 392 has one end connected to the plate 393 and an actuator 425, which may, for example, comprise a hydraulic or pneumatic cylinder, is connected to the other end of the connecting rod 392. The vertical of the actuator 425 makes the connecting shaft 392, the connecting plate 393 and the pusher rods 395 move in the direction of an arrow P or P' in FIG. 9.

The connecting rod 392 and the actuator 420, which are connected to each other, are also connected to a slider 431. The slider 431 moves along a horizontal shaft 429. An actuator 391, which may comprise a hydraulic or pneumatic cylinder, is connected to the slider 431 so that its reciprocative motion may cause the slider 431 move on the shaft 429 in the direction of an arrow Q or Q' in FIG. 9. The shaft 429 and the actuator 391 are supported on the respective plates 427 and 435, which are secured to the upper plate 411.

When the actuator 409 is driven in the direction of an arrow W in FIG. 9, the rack 421 is also moved in the direction of the arrow W. As a result, the sectoral gear 396 is rotated in the direction of an arrow R and the back plate 301 is also rotated about the shaft 380 in the direction of the arrow R. If the actuator 409 is driven in the direction of an arrow W', the rack 421 is also moved in the direction of the arrow W' and the back plate 301 is, therefore, rotated about the shaft 380 in the direction of an arrow R'. The back plate 301 takes its position shown in FIG. 9 when the actuator 409 has been completely retracted in the direction of the arrow W'. Any further rotation of the back plate is prevented by a stopper 412 provided on the upper plate 411. Any further rotation of the back plate 301 and the plate 393 in the direction of the arrow R' is prevented, as the plate 393 abuts on the stopper 412.

An actuator 401, which may, for example, comprise a hydraulic or pneumatic cylinder, is supported by a frame 402 on the top of the upper plate 411. The actuator 401 has a driving shaft 401*a* to which a connecting plate 403 is connected. A plurality of push rods 405 are each connected to the connecting plate 403 at one end thereof. When the actuator 401 is driven in the direction of an arrow S or S' in FIG. 9, the push rods 405 are moved in the direction of the arrow S or S', synchronously.

A stopper 415 and a knock 417 are attached to the respective upper plate 411 and a stand 413 in order to maintain the horizontal position of the back plate 301 when the back plate 301 has been rotated in the direction of the arrow R to a horizontal position. When the back plate 301 has been rotated to its position shown at 301' by two-dot chain lines in FIG. 9, the back plate 301 abuts on the stopper 415 in order to prevent any further rotation thereof in the direction of the arrow R.

When the back plate 301 abuts on the stopper 415, the knock 417 is pushed leftwardly as viewed in FIG. 9 by an actuator 419 and engages a knock receiving member 301*a* provided at one end of the back plate 301 to maintain it in its horizontal position.

The actuator 419 and the knock 417 are supported on the stand 413 elongating from the upper plate 411.

A shaping block 600 is disposed on a frame 441. A rail 443 is provided on the frame 441 and a linear motion bearing 445 is movablly provided on the rail 443. A base 447 is secured on the linear motion bearing 445 and the shaping block 600 is supported on the base 447.

An actuator 453, which may, for example, comprise a hydraulic or pneumatic cylinder, is connected to the base 447. The axial motion of the actuator 453 causes the shaping block 600 and the base 447 to move along the rail 443 with the linear motion bearing 445 in the direction of an arrow T or T' in FIG. 9. The shaping block 600 takes its position shown by solid lines in FIG. 9 when the actuator 453 has been advanced completely, while it takes its position shown at 600' by two-dot chain lines when the actuator 453 has been completely retracted.

The base 447 is provided therein with a palletspace 611 having a pair of openings located on the right and left sides, thereof as viewed in FIG. 9. The pallet space 611 is provided for holding a pallet 501. An actuator 455 is provided on the lefthand of the block for ejecting the pallet 501 from the space 611 to the right. A lifting plate 451 is provided below the pallet 501 and an actuator 449 is connected to the lifting plate 451 to move the pallet 501 in the direction of an arrow U or U'.

Figure 10:
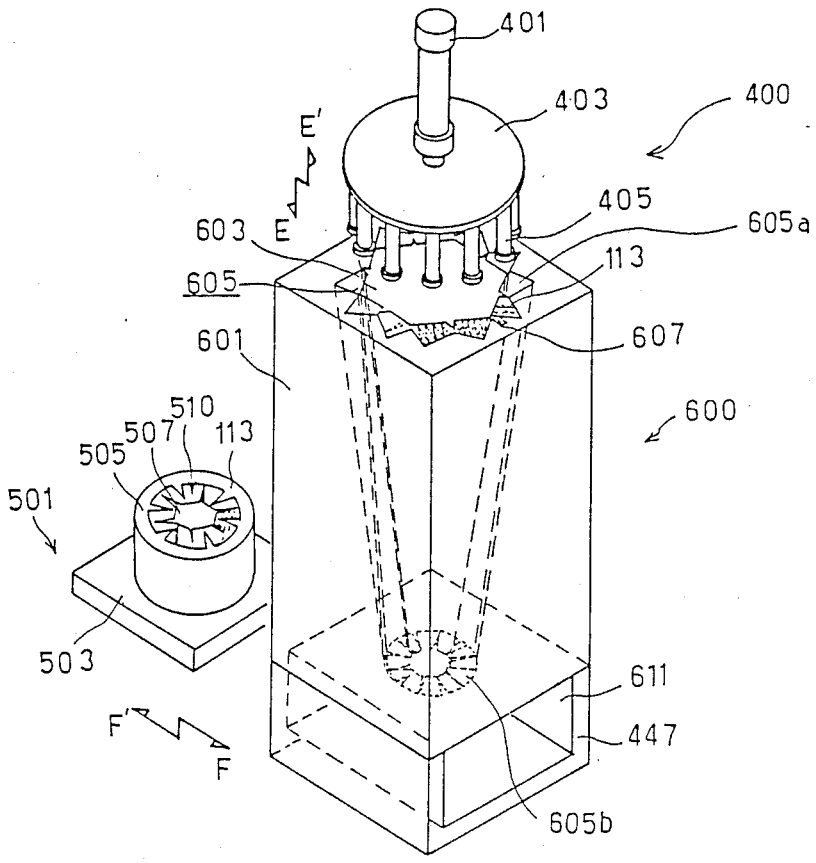
FIG. 10 is a perspective view of the shaping device with a pallet.

The detail of the shaping block 600 is described by referring FIG. 10.

FIG. 10 is a perspective view of the shaping block 600. The base 447 is located under the shaping block 600, as already stated, and the pallet space 611 which can hold the pallet 501 is defined between the base and the shaping block 600.

Figure 11:
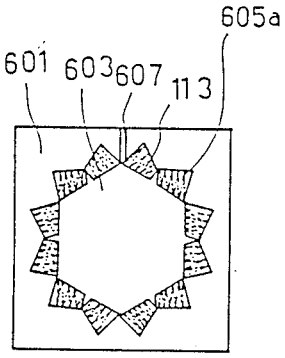
FIGS. 11 to 13 show different cross-sectional shapes of a shaping space.
Figure 12:
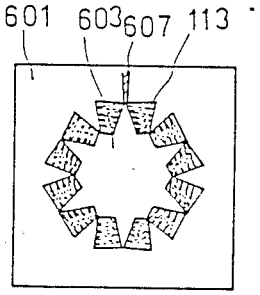
Figure 13:
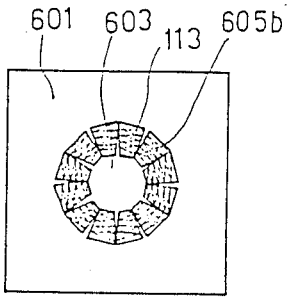

The shaping block 600 comprises an outer casing 601 and a core 603 disposed therein. The inner wall of the casing 601 and the outer wall of the core 603 define therebetween an element shaping space 605 extending longitudinally of the block. The space 605 has an open upper end 605*a* which is shown in FIG. 11 and an open lower end 605*b* which is open to the pallet space 611 and is shown in FIG. 13. FIG. 13 shows the final shape of a filter element. The element shaping space 605 has a cross-sectional shape which gradually changes from the shape of its upper end 605*a* as shown in FIG. 11 to the shape of its lower end 605*b* as shown in FIG. 13. The space 605 has intermediate the ends thereof a cross-sectional shape of which is shown by way of example in FIG. 12.

The shape of the element shaping space 605 at its upper end 605*a* which is shown in FIG. 11 is equal to that of the element holding space 350 shown in FIG. 5. The shape of the space at its lower end 605*b* which is shown in FIG. 13 is equal to the final shape of a filter element.

The casing 601 and the core 603 are connected to each other in a mutually fixed positional relation by a mounting plate 607.

The pallet 501 is comprised of a base plate 503, a casing 505 on the base plate 503 and a core 507 in the casing 505. The outer wall of the core 507 and the inner wall of the casing 505 define therebetween a pallet space 510 having a cross-sectional shape which is the same as that of the lower end 605*b* of the shaping device 600 or the shaping space 113 shown in FIG. 13. Therefore, the element 113 leaving the lower end of the element shaping space 605 maintains its shape when it is transferred into the pallet space 510.

When the back plate 301 is in its position shown at 301' by the two-dot chain lines in FIG. 9 while the shaping device 600 is in its position shown at 600' by the two-dot chain lines, the pusher rods 405 extend through the rod receiving holes 381 of the back plate 301 and face the upper end of the element shaping space 605 of the shaping device 600.

Figure 14:
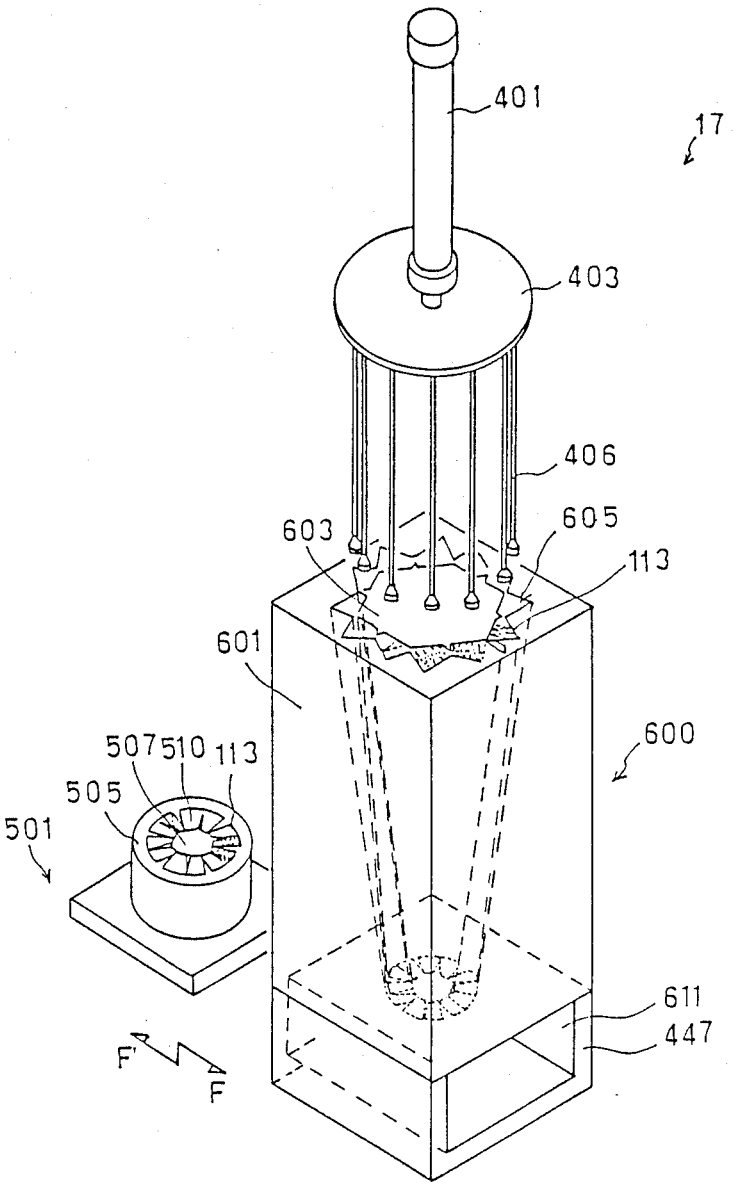
FIG. 14 is a perspective view of a modified shaping device.

The actuator 401 is driven by a distance which corresponds to the height of a single element 113. A plurality of elements 113 are received one after another into the element shaping space 605 through its upper end and are moved down one by one each time the pusher rods 405 are lowered. Therefore, each element 113 is transferred into the pallet 501 through the lower end of the space 605 when the pusher rods 405 have been actuated a plurality of times. Alternatively, each pusher rod 405 may be formed from a deformable material, such as a piano wire, and have a length which is equal to that of the shaping space 605, as shown in FIG. 14. The pusher rods shown in FIG. 14 are used for pushing one filter element 113 at a time from the upper end of the space 605 to its lower end for delivery to the pallet 501.

The operation of the apparatus is described hereinafter.

The strip 110 which has been unwound from the roll 109 is fed into the nip between the line marking rollers 111 via the first and second auxiliary rollers 108 and 107 and a plurality of appropriately spaced apart folding lines are cut in the surfaces of the strip by the rollers 111.

Then, the strip 110 enters the nip between the folding rollers 112 and is folded into a continuously corrugated shape. An appropriate length forming a filter element 113 is cut from the strip by the cutter 114 and is longitudinally conveyed by the chain 116.

The element 113 is, then, transferred from the folding device 100 into the guide plates 209 in the contracting device 200. The element 113 in the contracting device 200 is supported by the upper guide members 220 of the expanding and contracting device 201 in its lowest ridge portions and by the lower guide members 227 in its highest ridge portions. Then, the driving device 253 is driven in order to drive the chains 213 in the direction of the arrow A in FIG. 1 through the coupling 251 and the sprockets 211. As the attachments 241 are connected to the chains 213, the blocks 207 are moved in the direction of the arrow A, too. Therefore, the upper and lower blocks 202 and 203 which are connected to the blocks 207 by the upper and lower guide bars 205*a* and 205*b*, are also moved in the direction of the arrow A. The upper blocks 202 are moved to one another, as they are connected to one another by the pantograph 223. The lower blocks 203 are also moved to one another, as the lower guide members 227 which are connected to the lower blocks 203 move along the guide grooves 235. The element 113 is, therefore, contracted in the direction in which the upper and lower guide members are juxtaposed, i.e., the ridges of the element are juxtaposed to one another, while it is caused to slide along the guide plates 209 in the direction of the arrow A.

The element 113 which has been appropriately contracted reaches the shaping gate 290 and is transferred therethrough to the rounding device 300 by the pusher 390.

The element 113 is pushed into the element holding space 350 of the blocks 331 to 341 in the rounding device 300.

Figure 17:
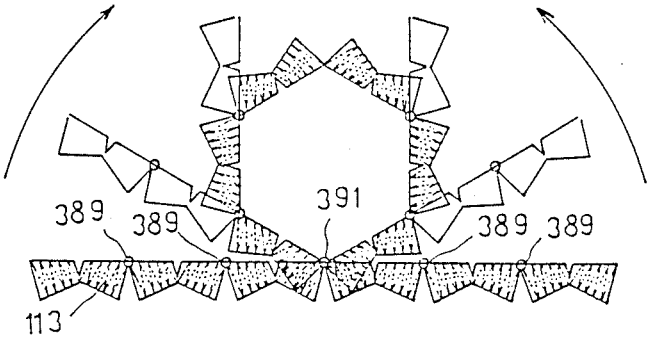

Then, the actuator 375 drives the element 113 in order to be deformed in two opposite directions from the pin 391 through the rack 373, first and second gears 371 and 372, levers 369 and 370 and link plates 365 and 366 so that the element 113 forms a circular shape as shown in FIG. 17. The blocks 331 to 341 which have been placed in a circular array are held together by the pins when the pins are inserted through the pin holes 362 of the links 361*a*and 361*f*. Then, the actuator 409 rotates the back plate 301 in the direction of the arrow R in FIG. 9 to its position shown at 301' by the two-dot chain lines.

Then, the actuator 453 moves the shaping device 600 to its position shown at 600' by the two-dot chain lines in FIG. 9.

The actuator 401, then, advances the pusher rods 405 in the direction of the arrow S. The pusher rods 405 pass through the rod receiving holes 381 of the back plate 301 and push the filter element out of the blocks of the rounding device 300 into the shaping space 605 of the shaping device 600 through its upper end. When one filter element has been placed in the shaping device 600, the shaping device 600 is returned to its position shown by the solid lines in FIG. 9 and the back plate 301 is also returned to its position shown by the solid lines.

The sequence of operation which has hereinabove been described is repeated for rounding a second filter element and inserting it into the shaping device 600 through its upper end. The second element is pushed down through the shaping device by the element which has first been inserted thereinto. This operation is repeated for moving a plurality of filter elements one after another from the upper end of the shaping device to its lower end. As each element is moved down through the shaping space 605, it is gradually deformed into a final cross-sectional shape, since the space 605 has a gradually varying cross-sectional shape which terminates at its lower end in the final shape of the filter element.

The filter element 113 which has been formed into its final shape is transferred into the inner space 611 of the pallet 501 in the pallet space 611. Then, the actuator 455 is driven for movement to the right in FIG. 9 to eject the pallet 501 in the same direction.

When the element is transferred from the shaping device 600 to the pallet 501, the pallet 501 is raised by the actuator 449 in the direction of the arrow U in FIG. 9 to its uppermost position. When the element 113 has been received in the pallet 501, the actuator 449 is driven in the direction of the arrow U' to lower the pallet to its original position. Then, the actuator 455 ejects the pallet 501, as described hereinabove.

The pallet 501 holding the element 113 is, then, conveyed to an element lowering device not shown.

When the element 113 is transferred from the contracting device 200 to the rounding device 300, the blocks 331 to 341 of the rounding device 300 lie in a straight line. When the element is transferred from the rounding device 300 to the shaping device 600, the blocks 331 to 341 lie in a curcular array as shown in FIG. 5. The pusher rods 395 of the pusher 390 are moved in the direction of the arrow Q or Q' in FIG. 9 by the actuator 391 and in the direction of the arrow P or P' by the actuator 425.

Figure 15:
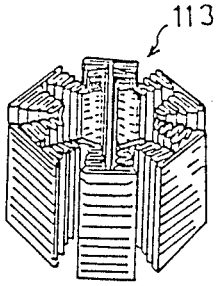
FIG. 15 is a perspective view of a final filter element.

The back plate 301 is rotated in the direction of the arrow R or R' if the actuator 409 is driven in the direction f the arrow W or W'. The shaping device 600 is reciprocatively moved by the actuator 453 between its positions shown by the broken and solid lines in FIG. 9 when each filter element 113 is transferred to the pallet 501. Thus, each filter element is shaped into a product having a plurality of folds as shown in FIG. 15.

What is claimed is:

1. An apparatus for contracting a continuously corrugated strip of material for a filter element so that a distance between adjacent ridges of said corrugated strip is reduced, said apparatus comprising:

a guide plate on which said strip slides in a direction perpendicular to a direction in which said strip is contracted;

said guide plate including a plurality of guide grooves extending in a direction substantially perpendicular to said direction in which said strip is contracted, said grooves being spaced apart from one another by a distance which decreases from one end of said guide plate to another;

a plurality of lower guide members mounted for moving together along said guide grooves, while supporting said strip thereon in such a manner that each of said lower guide members engages in a respective valley formed in a lower surface of said strip; and a plurality of upper guide members each located between a pair of adjacent lower guide members and spaced apart from one another by a distance which decreases with the movement of said upper guide members from said one end of said guide plate to said other end thereof, said upper guide members supporting said strip in such a manner that each of said upper guide member engages in a respective valley formed in an upper surface of said strip.

2. An apparatus for rounding a continuously corrugated strip of material for a filter element so that both ends of said strip are connected to each other, said apparatus comprising:

a back plate having a flat surface;

a plurality of holding blocks connected to each other and provided on said flat surface of said back plate, said holding block having a holding space in which said corrugated strip of material for a filter element is held;

block connecting means rotatably connecting adjacent pairs of said holding blocks on said flat surface of said back plate;

block pivoting means for pivoting two of said plurality of holding blocks on said back plate;

block moving means connected to both ends of said plurality of holding blocks for moving said plurality of holding blocks in such a manner that said plurality of holding blocks form a circle with both ends of said holding blocks abutting each other; and attaching means for detachably attaching both ends of said holding blocks to each other.

3. An apparatus for shaping a continuously corrugated strip of material for a filter element both ends of which are connected to each other so that the continuously corrugated strip forms a circle, said apparatus comprising:

a shaping block having a bore defined therethrough and a core member mounted within said bore, the sectional shape between an inner wall of said shaping block which defines said bore and an outer wall of said core member at one end of said shaping block being the same shape as the continuously corrugated strip of material so that the continuously corrugated strip of material can be inserted between said inner wall and said core member, the sectional shape between the inner wall of said shaping block and the outer wall of said core member at the other end of said shaping block being a predetermined shape of the filter element and an area of the sectional shape between the inner wall of said shaping block and the outer wall of said core member between said one end and said other end of said shaping block being continuously reduced from said one end to said other end of said shaping block; and pushing means for pushing the continuously corrugated strip of material within said bore from said one end of said shaping block toward said other end of said shaping block.

4. An apparatus for making a filter from a material for a filter element, comprising:

a contracting apparatus for contacting a continuously corrugated strip of material for a filter element so that a distance between adjacent ridges of said corrugated strip is reduced, said contracting apparatus including:

a guide plate on which said strip slides in a direction perpendicular to a direction in which said strip is contracted;

said guide plate including a plurality of guide grooves extending in a direction substantially perpendicular to said direction in which said strip is contracted, said grooves being spaced apart from one another by a distance which decreases from one end of said guide plate to the other;

a plurality of lower guide members mounted for moving together along said guide grooves, while supporting said strip thereon in such a manner that each of said lower guide members engages in a respective valley formed in a lower surface of said strip; and a plurality of upper guide members each located between a pair of adjacent lower guide members and spaced apart from one another by a distance which decreases with the movement of said upper guide members from said one end of said guide plate to said other end thereof, said upper guide members supporting said strip in such a manner that each of said upper guide member engages in a respective valley formed in an upper surface of said strip, a rounding apparatus for rounding the continuously corrugated strip of the material for the filter element so that both ends of said strip are connected to each other, said rounding apparatus including:

a back plate having a flat surface;

a plurality of holding blocks connected to each other and provided on said flat surface of said back plate, said holding block having a holding space in which said corrugated strip of material for a filter element is held;

block connecting means rotatably connecting adjacent pairs of said holding blocks on said flat surface of said back plate;

block pivoting means for pivoting two of said plurality of holding blocks on said back plate;

block moving means connected to both ends of said plurality of holding blocks for moving said plurality of holding blocks in such a manner that said plurality of holding blocks form a circle with both ends of said holding blocks abutting each other; and attaching means for detachably attaching both ends of said holding blocks to each other, and a shaping apparatus for shaping the continuously corrugated strip of material for the filter element both ends of which are connected to each other so that the continuously corrugated strip forms a circle, said shaping apparatus including:

a shaping block having a bore defined therethrough and a core member mounted within said bore, the sectional shape between an inner wall of said shaping block which defines said bore and an outer wall of said core member at one end of said shaping block being the same shape as the continuously corrugated strip of material so that the continuously corrugated strip of material can be inserted between said inner wall and said core member, the sectional shape between the inner wall of said shaping block and the outer wall of said core member at the other end of said shaping block being a predetermined shape of the filter element and an area of the sectional shape between the inner wall of said shaping block and the outer wall of said core member between said one end and said other end of said shaping block being continuously reduced from said one end to said other end of said shaping block; and pushing means for pushing the continuously corrugated strip of material within said bore from said one end of said shaping block toward said other end of said shaping block.

* * * * *